US005183452A

United States Patent [19]

Bacon et al.

[11] Patent Number: 5,183,452

[45] Date of Patent: Feb. 2, 1993

[54] EXERCISE MACHINE

[76] Inventors: John L. Bacon; Jonathan M. Bacon, both of 6141 NW Gary St., Lincoln, Nebr. 68521

[21] Appl. No.: 778,710

[22] Filed: Oct. 18, 1991

[51] Int. Cl.[5] ..... A63B 21/06

[52] U.S. Cl. ..... 482/97; 482/80; 482/145

[58] Field of Search ..... 482/79, 80, 93, 97, 482/145, 94, 100, 137

[56] References Cited

U.S. PATENT DOCUMENTS

| | | | |
|---|---|---|---|
| 3,682,475 | 8/1972 | Walker | 482/145 X |
| 3,850,430 | 11/1974 | Hamilton | 482/97 |
| 3,863,916 | 2/1975 | Clinge | 482/97 X |
| 4,266,766 | 5/1981 | Calderode | 482/97 |
| 4,509,746 | 4/1985 | Mask | 482/97 X |
| 4,537,394 | 8/1985 | Golinskt, Jr. | 482/109 |
| 4,572,505 | 2/1986 | Kornhaus | 482/97 X |
| 4,733,859 | 3/1988 | Kock et al. | 482/79 |
| 4,807,874 | 2/1989 | Little | 482/80 |
| 4,813,666 | 3/1989 | Costilow et al. | 482/97 X |
| 5,044,628 | 9/1991 | Bracci et al. | 482/93 X |

*Primary Examiner*—Robert Bahr

*Attorney, Agent, or Firm*—Zarley, McKee, Thomte, Voorhees & Sease

[57] ABSTRACT

An exercise machine includes a base frame with a seat adjustably connected thereto for longitudinal movement towards and away from a foot support on the base frame. A bent arm is pivotally mounted on the base frame adjacent the foot support, and has a pair of cushions adjustably mounted on the arm, so as to pivot through an arc with respect to the foot supports. Weights may be added to the bent arm so as to further bias the cushions against pivotal movement. A person seated on the machine exercises the tibialis anterior muscle by pivoting the cushions with the toes of the foot with respect to the foot support.

2 Claims, 3 Drawing Sheets

EXERCISE MACHINE

TECHNICAL FIELD

The present invention relates generally to mechanical exercising machines, and more particularly to an apparatus for exercising specific muscles in the leg.

BACKGROUND OF THE INVENTION

Various weight lifting and exercise machines have been known for many years. These machines are designed to exercise muscles throughout the body, including leg muscles. However, to date, none of these apparatus are designed to exercise the tibialis anterior muscle, which is utilized to raise the forward part of the foot.

It is therefore an object of the present invention to provide an improved exercise machine.

Another object is to provide an exercise machine which will work the tibialis anterior muscle.

A further object is to provide an exercise machine which is simple to operate, economical to manufacture and refined in appearance.

These and other objects will be apparent to those skilled in the art.

SUMMARY OF THE INVENTION

The exercise machine of the present invention includes a base frame with a seat adjustably connected thereto for longitudinal movement towards and away from a foot support on the base frame. A bent arm is pivotally mounted on the base frame adjacent the foot support, and has a pair of cushions adjustably mounted on the arm, so as to pivot through an arc with respect to the foot supports. Weights may be added to the bent arm so as to further bias the cushions against pivotal movement. A person seated on the machine is able to exercise the tibialis anterior muscle by pivoting the cushions with the toes of the foot with respect to the foot support.

DESCRIPTION OF THE PREFERRED EMBODIMENT

Figure 1:
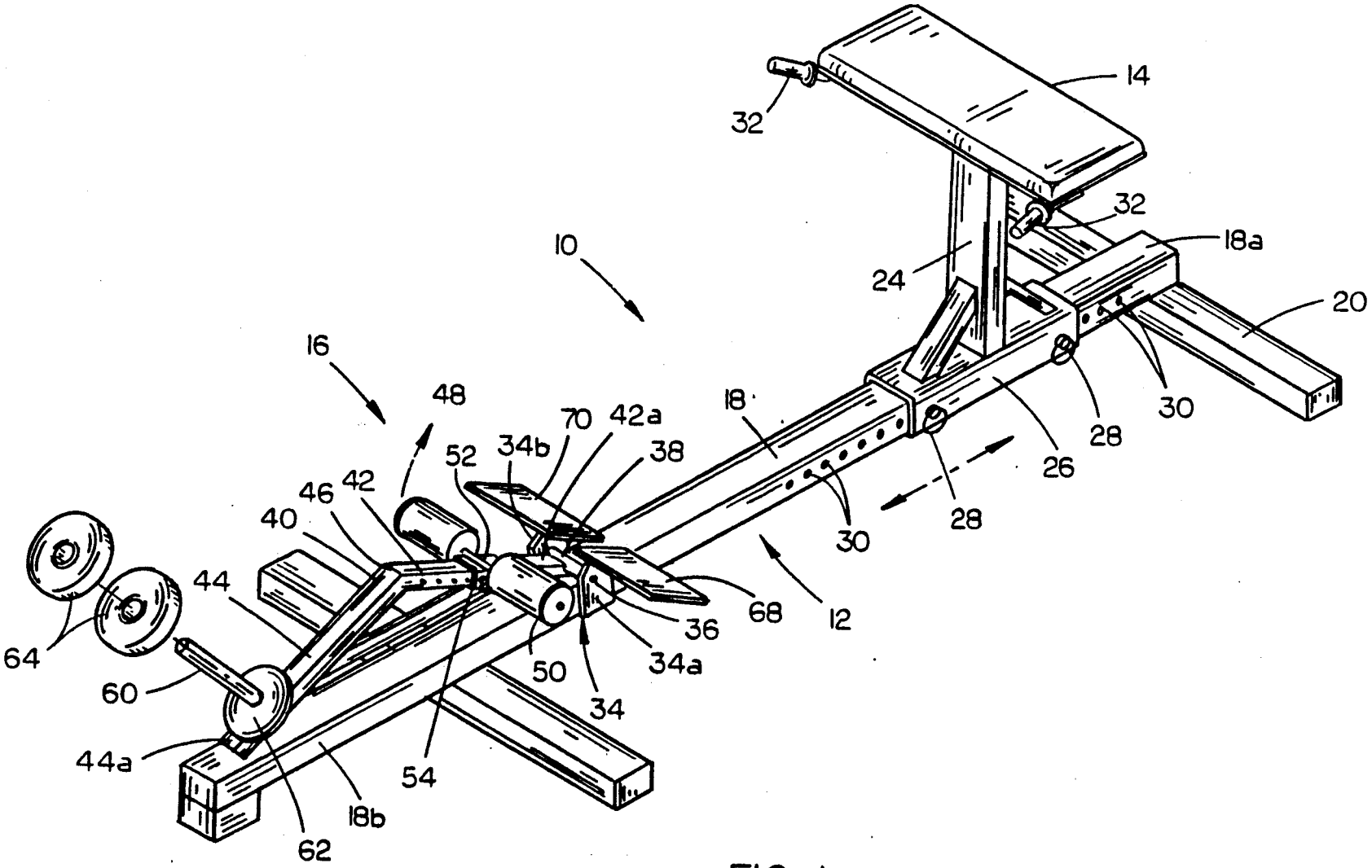
FIG. 1 is a perspective view of the exercise machine of the present invention.
Figure 2:
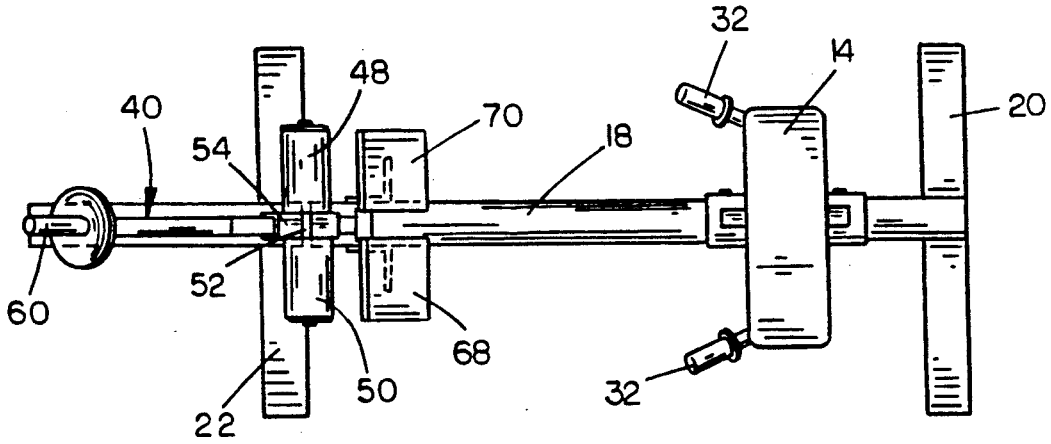
FIG. 2 is a top view of the invention.

Referring now to the drawings, in which identical or corresponding parts are identified with the same reference numeral, and more particularly to FIG. 1, the exercise machine of the present invention is designated generally at 10 and includes a base frame 12 with a seat 14 adjustably mounted to one end thereof, and an operable mechanism designated generally at 16 for performing the actual exercise, mounted at the end opposite seat 14.

As shown in the drawings, base frame 12 includes an elongated horizontal tube 18 with a transversely mounted horizontally-oriented first leg 20 mounted at a first end 18*a* of tube 18. A second leg 22 is also transversely mounted parallel to first leg 20 and located adjacent the forward end 18*b* of tube 18.

Seat 14 is mounted on a vertical post 24 which is mounted in an upright position on a sleeve 26, as shown in FIG. 1. Sleeve 26 is slidably mounted on tube 18, and has a pair of selectively removable locking pins 28 journaled through apertures in sleeve 26 and through apertures 30 in horizontal tube 18. Apertures 30 are uniformly spaced apart along horizontal tube 18 such that sleeve 26 and seat 14 may be adjusted to various distances from mechanism 16. A pair of handles 32 are mounted to the forward corners of seat 14 to enable the user to stabilize the body during exercising.

Operable mechanism 16 includes a U-shaped bracket 34 mounted to tube 18 forwardly of seat 14, with a pair of upstanding legs 34*a* and 34*b* projecting above the top surface of tube 18. A bolt 36 is mounted through coaxial apertures in the upper end of legs 34*a* and 34*b*, and is journaled through a tube 38, to permit tube 38 to pivot on bolt 36. A rigid bent tubular arm 40 includes a rearward section 42 and a forward section 44 joined at a bend 46, with the rearward end 42*a* of rearward section 42 mounted on tube 38 for pivotal movement therewith.

Figure 5:
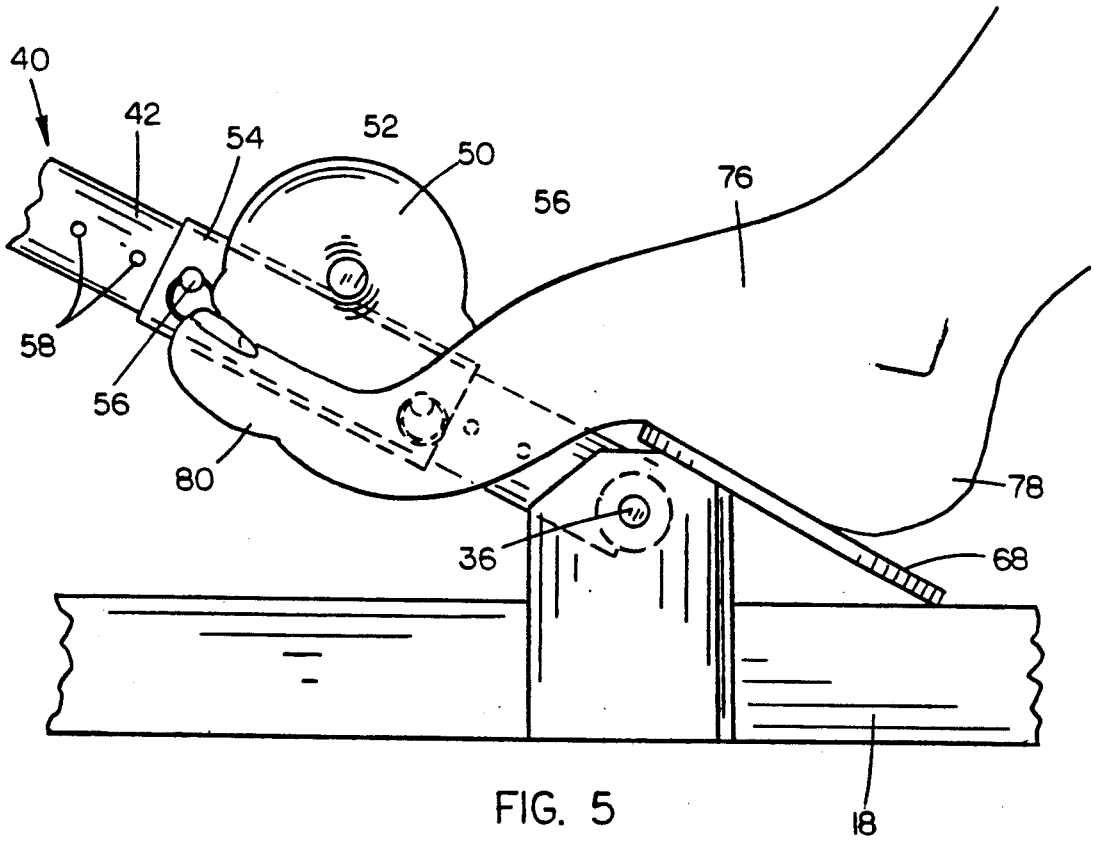
FIG. 5 is an enlarged side elevational view of the invention in use.

A pair of cylindrical cushions 48 and 50 are mounted on opposing ends of an elongated rod 52, rod 52 being mounted to a sleeve 54 slidably connected to the rearward section 42 of bent arm 40. As shown in FIG. 5, sleeve 54 has a pair of locking pins 56 extending through apertures in sleeve 54 and journaled through apertures 58 in rearward section 42. Locking pins 56 are removable to allow selective adjustment of sleeve 54 along rearward section 42 of bent arm 40. In this way, cushions 48 and 50 may be slidably adjusted along rearward section 42 with respect to the bolt 36.

Figure 3:
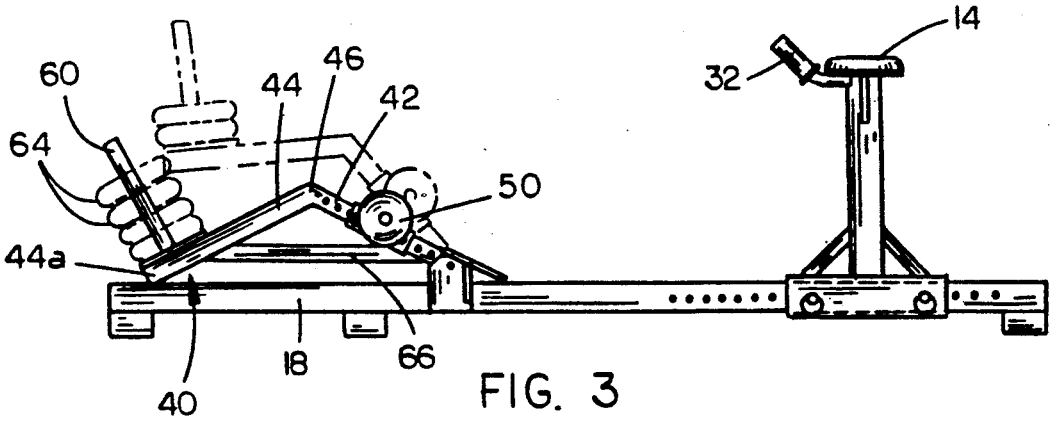
FIG. 3 is a side elevational view of the invention.

A short post 60 is mounted in an upright orientation to the forward end 44*a* of forward section 44 of bent arm 40. A disk-shaped base plate 62 is then mounted on post 60 so as to support one or more disk-shaped weights 64 on post 60, as shown in FIG. 1. FIG. 3 shows bent arm 40 having an angle of approximately 125° between forward section 44 and rearward section 42, such that bend 46 is located spaced above horizontal tube 18 when arm 40 is resting with forward end 44*a* in contact with horizontal tube 18. Arm 40 is pivotable to the position shown in broken lines in FIG. 3, with post 60 maintaining an upright position to hold weights 64 thereon. A cross brace is mounted between forward and rearward sections 44 and 42 to rigidly maintain the bent orientation of arm 40.

Referring again to FIG. 1, a pair of foot supporting plates 68 and 70 are mounted to the upper edges of legs 34*a* and 34*b* of bracket 34, in a generally coplanar orientation. As shown in FIG. 5, foot plates 68 and 70 are sloped at an angle with respect to horizontal tube 18, and are generally parallel to the longitudinal axis of rearward section 42 of arm 40 when arm 40 is in the rest position.

Figure 4:
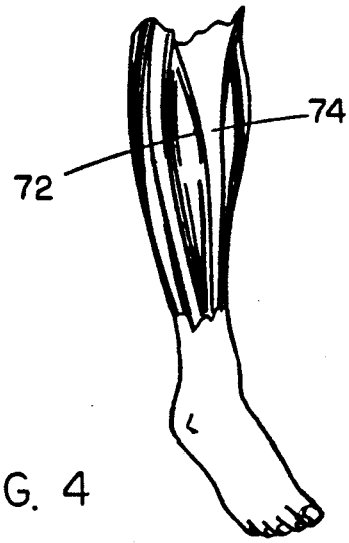
FIG. 4 is a perspective view showing the pertinent muscle of the leg to which the invention applies.

As shown in FIG. 4, the tibialis anterior muscle 72 is located immediately adjacent the large main bone 74 of the leg. The exercise machine 10 of FIG. 1 is designed to work this muscle, which is utilized for raising the forward part of the foot. While other exercise machines are known which exercise various muscles of the leg, none are known which are designed to work this particular muscle.

Figure 6:
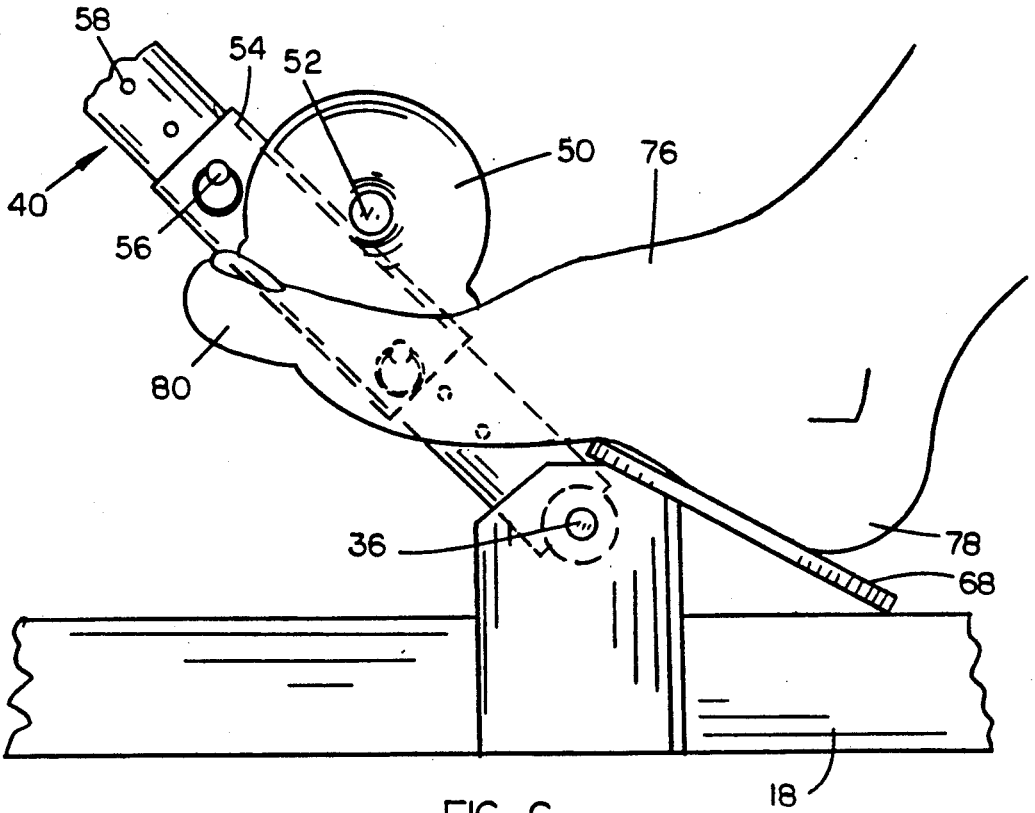
FIG. 6 a view similar to FIG. 5 showing movement of the foot to operate the invention.

In operation, a person will sit on seat 14 and grip handles 32, placing a foot 76 (see FIGS. 5-6) on a plate 68 and 70. The heel 78 of foot 76 is supported on plate 68, as shown in FIG. 5, and the toes 80 are placed under cushion 50. Once an appropriate amount of weight has been added to post 60 (as shown in FIG. 3) the person will work the tibialis anterior muscle by raising the toes 80 from the position shown in FIG. 5 to the position shown in FIG. 6, thereby pivoting arm 40 about bolt 36 (which is also shown in FIG. 3).

Whereas the invention has been shown and described in connection with the preferred embodiment thereof, it will be understood that many modifications, substitutions and additions may be made which are within the intended broad scope of the appended claims. There has therefore been shown and described an improved exercise machine which accomplishes all of the above stated objects.

We claim:

1. An exercise machine, comprising:

a base frame having forward and rearward ends;

seat means connected to the rearward end of said frame for supporting a person;

foot support means connected to said frame forwardly of the seat means for supporting the heel of a foot;

said foot support means including first and second plates mounted generally coplanar and transversely with respect to the longitudinal axis of said frame, for supporting two feet;

cushion means operable connected to said frame and extending forwardly from said foot support means and operable between a first position at rest, and a second position above and rearward of the first position, whereby toes of a foot on the foot support are located beneath the cushion means to operate the cushion means between the first and second position;

said cushion means including first and second cushions rotatably connected to said arm for pivotal movement therewith and free rotation thereon, said first cushion located to be operated by a foot on the first plate and the second cushion located to be operated by a foot on the second plate;

said cushion means including an arm having forward and rearward ends, pivotally connected at the rearward end to said frame for pivotal movement of said cushion means independently of said foot support means between the first and second positions;

said seat being adjustably connected to said frame for selective adjustment along the longitudinal axis of said frame, forwardly and rearwardly with respect to said foot support means; and means for connecting a plurality of weights to said arm, located such that weights connected to said arm bias said cushion means from the second position to the first position.

2. The exercise machine of claim 1, wherein said arm is bent intermediate the forward and rearward ends such that the forward and rearward ends are located below the bend when said cushion means is in the first position, and wherein said forward end of said frame is located beneath the forward end of said arm to support the arm when located in the first position.

* * * * *